US005318129A

United States Patent [19]

Wittrisch

[11] Patent Number: 5,318,129

[45] Date of Patent: Jun. 7, 1994

[54] METHOD AND DEVICE FOR SETTING UP SONDES AGAINST THE WALL OF A CASED WELL

[75] Inventor: Christian Wittrisch, Rueil-Malmaison, France

[73] Assignee: Institut Francais du Petrole, Rueil Malmaison Cedex, France

[21] Appl. No.: 848,138

[22] Filed: Mar. 9, 1992

[30] Foreign Application Priority Data

Mar. 8, 1991 [FR] France ..... 91 02939

[51] Int. Cl.[5] ..... E21B 47/00; G01V 3/26; G01V 3/34

[52] U.S. Cl. ..... 166/336; 166/66.5; 166/250; 166/381; 367/86; 367/911

[58] Field of Search ..... 166/66.5, 250, 336, 166/338, 339, 381; 367/86, 911

[56] References Cited

U.S. PATENT DOCUMENTS 2,530,308 11/1950 martin ..... 367/86 X
3,110,257 11/1963 Lebourg .
3,182,724 5/1965 Shore ..... 166/66.5 X
4,953,136 8/1990 Kamata et al. ..... 367/911 X

*Primary Examiner*—Ramon S. Britts
*Assistant Examiner*—Roger J. Schoeppel
*Attorney, Agent, or Firm*—Antonelli, Terry, Stout & Kraus

[57] ABSTRACT

Sondes provided with magnets are used in wells fitted with a metallic casing. The sondes are pressed at the surface against the inner wall of the casing and taken down towards the bottom by means of a stiff driving element such as a tubing provided with thrust driving means for the longitudinal drive and lateral extensions for the lateral positioning of the sonde, or using pulling slings, etc. The wall of the sonde pressed against the casing can have the same bending radius as the casing in order to improve the coupling. The sonde can be associated with an electronic data acquisition and transmission box fastened to the tubing. Before any intervention is performed, the tubing is moved sufficiently in order to suppress any mechanical coupling with the sonde. After it has been used, the sonde can be displaced towards another point of measurement or taken up to the surface by moving the tubing.

18 Claims, 3 Drawing Sheets

METHOD AND DEVICE FOR SETTING UP SONDES AGAINST THE WALL OF A CASED WELL

BACKGROUND OF THE INVENTION

The present invention relates to a method and a device for temporarily setting up one or several sondes against the inner wall of a cased well. The well sonde according to the invention can be installed in a well for example for various operations connected with the production of hydrocarbons.

A well equipped for petroleum production for example comprises a casing set up during the drilling operations. It is held in position with cement injected into the annular space between the casing and the wellbore. A tubing for the flowing of the fluids outside the producing zone is set up in the cased well.

The well sonde according to the invention can be used in this case for containing seismic or acoustic sensors (accelerometers, geophones, piezoelectric sensors, etc) which are to be coupled with the casing for the passive monitoring of the zone in production to determine the evolution thereof in time for example.

The well sonde according to the invention can also be used for example within the framework of operations for the hydraulic fracturing of a petroliferous zone where a fluid under pressure is injected into a confined well portion to generate fractures therein, in order to favour the production thereof. It is well-known that, in this type of operations, it is useful to set up in the well a sonde fitted with directional sensors sensitive to the noises transmitted by the rocks subjected to the fracturing fluid, in order to determine the directions of propagation of the fractures. Temperature and pressure sensors can also be included in such a sonde.

Various sondes which can be used within the framework of hydraulic fracturing operations are well-known through U.S. Pat. No. 4,690,214 4;898,237 4,898,240 and 4,898,241 assigned to the same assignee. They are taken down as far as the intervention zone by means of a tubing constituted by interconnecting tubular sections and linked to a surface control and recording installation by an electric carrying cable which can possibly be connected when the sonde has already been taken down into the well. Using such a tubing sometimes presents drawbacks for some applications. It is the case for fracturing operations where propping agents must be injected through the tubing, which, as can be noticed, tend to erode the electric carrying cable and sometimes to obstruct the tubing, which sometimes prevents from taking up the sonde after using it.

A process and a device for installing a reception array in a well, which essentially consists in arranging sensors outside the casing and in drowning them in the cement injected into the annular space between the casing and the well, are well-known through U.S. Pat. No. 4,775,009. This process provides a particularly good coupling of the sensors with the surrounding formations. It is suitable for a stationary installation because of the irreversible nature thereof.

SUMMARY OF THE INVENTION

The method according to the invention is suitable for temporarily setting up, for interventions or measurement in a well provided with a casing, at least one measuring sonde connected through conducting means to a control and recording array and for recovering the sonde after use, which allows to avoid the drawbacks mentioned above.

It comprises in combination:

adding to each sonde magnetic coupling means capable of holding the sonde pressed against the inner wall of the casing, moving towards an area of measurement in the well each sonde held pressed against said wall through a magnetic coupling, by means of a stiff driving element linked to an operating assembly and, before any intervention of each sonde, mechanically uncoupling each said sonde in relation to said stiff driving element through the relative longitudinal displacement thereof in relation to the sonde.

According to a first embodiment procedure, moving each sonde is performed through a direct contact between the sonde and the stiff driving element.

Displacing each sonde is, for example, achieved by means of pushing parts forming thrusts, fastened to the stiff linking element on either side of the sonde and at a longitudinal distance in relation to one another higher than the largest longitudinal dimension of the sonde, and also by means of radial centering parts for limiting the angular clearance of said sonde in relation to the stiff linking element.

According to a second embodiment procedure, moving each sonde is performed by exerting a traction on flexible cables connecting said sonde with the stiff linking element.

The method can comprise transmitting the signals received by the sensors in the sonde to the control and recording array by means of an intermediate box fastened to said stiff driving element. In this case, the transmission is carried out by flexible linking conductors or possibly by an immaterial link between the sonde and the intermediate box, and by conductors between the box and the control and recording array.

Detecting means for checking the absence of contact between said sonde on one hand and the pushing parts and the centering parts on the other hand can also be used.

The method can also comprise using means for measuring the angular orientation of said sonde and, in this case, also possibly for measuring the angular orientation of the stiff driving element allowing by comparison the mechanical uncoupling of said sonde in relation to said driving element.

The method according to the invention offers a very reliable solution and easy to implement for setting up a sonde and for recovering it after an intervention in a well. The sonde being placed outside and uncoupled from the tubing, long-lasting monitoring periods can be achieved in wells used for the injection. The tubing is totally free for production or for various interventions. Within the framework of fracturing operations notably, the tubing can be used for injecting propping agents without any risk for the sonde which is out of reach in the annular space.

The method can be used within the framework of operations in producing wells for example, in which case a tubing externally provided with driving means as a stiff element for moving the sonde pressed against the casing is advantageously used. The tubing remains entirely free for the circulation of fluids production of petroleum effluents or active agents for interventions in the producing zone.

The device for implementing the method comprises at least one sonde for measuring instruments or sensors, provided with magnets capable of holding the sonde pressed against the inner wall of a casing in a well and a stiff element associated with driving means for translating said sonde pressed against the inner wall along said casing.

The driving means comprise for example thrusts fastened to the stiff element, which can be brought to rest against the pressed sonde by moving said tubing.

The driving means can also comprise slings or flexible cables fastened to the tubing and to the sonde, which can be tightened by moving said tubing.

The device can also comprise means for checking the mechanical uncoupling of said sonde in relation to the driving means.

The device can also comprise an acquisition and transmission array connected with said sonde by linking means and/or angular measuring means to know the position of said sonde in the well.

The stiff element is for example a tubing provided towards the base thereof with an expansible sealing element, for example a packer. The equipment of the well can also comprise various auxiliary sensors (such as hydrophones, pressure gages, temperature sondes, etc) which are arranged under the packer and which are associated with electric conductors crossing the sealing element, which allows to obtain a more comprehensive set of measuring data.

BRIEF DESCRIPTION OF THE DRAWINGS

Other features and advantages of the method and the device according to the invention will be clear from reading the description hereafter of embodiment procedures described by way of non limitative examples, with reference to the accompanying drawings in which.

DESCRIPTION OF THE PREFERRED EMBODIMENTS

Figure 1:
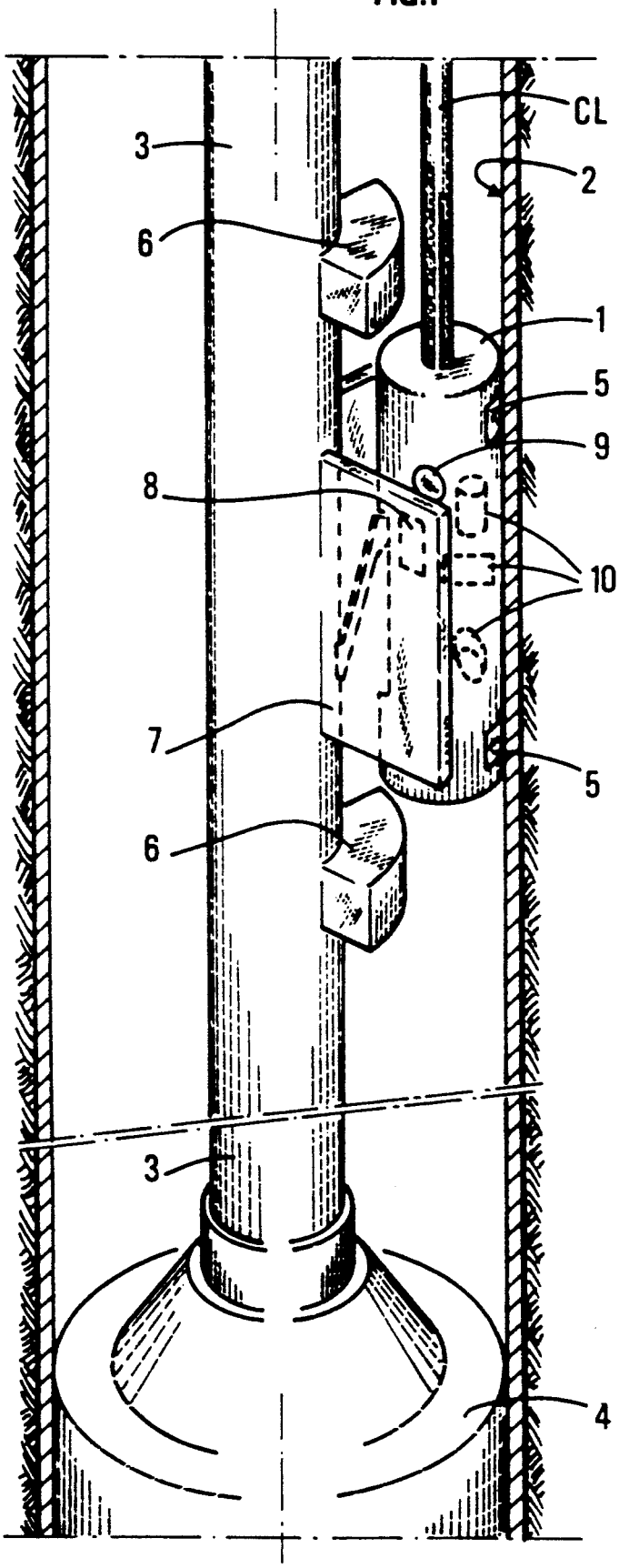
FIG. 1 shows a well sonde of a well-known type which is magnetically coupled with the wall of a casing and driving means allowing to move the sonde along a well.

The method according to the invention can for example apply to the setting up of a measuring sonde in a well equipped for petroleum production. This well comprises a casing 2 which is held in position by injecting cement into the annular space between the casing and the well. A tubing 3 provided with an expansible sealing element 4 such as a packer is taken down into the well to the zone which is brought into production, possibly following hydraulic fracturing operations. A sonde connected with a surface control and recording array by a multicore cable CL is to be taken down close to the producing zone to perform various measurings allowing to monitor the evolution of the basin.

The method according to the invention first consists in placing in the sonde to be taken down magnets 5 in sufficient number for holding the sonde pressed against the metallic casing 2. Magnets made of a samarium-cobalt alloy whose weight/volume ratio is very favourable are for example used. A tubular section provided with driving means is interposed on tubing 3. These means consist of two shoulders or thrusts 6 made of metal or elastomer whose longitudinal spacing is higher than the length of the sonde to be driven. The driving means can also comprise two radial extensions 7 when the sonde is to be positioned angularly in relation to the stiff tubing. The angular spacing of these two extensions is higher than the angular sector occupied by the sonde so that, in an intermediate position, the sonde touches none of the two extensions. Magnets 8 are preferably included in radial extensions 7. Electromagnetic sensors 9 are also included in the sonde to detect any contact between the sonde and extensions 7.

The sonde is thereafter introduced into the well by pressing it against the metallic casing 2 so that it is placed between the two shoulders 6 and the two radial extensions 7 of the tubing section 3. The tubing is taken down into the well through successive connections of sections and multicore cable CL is unwound progressively. The tubing drives during the progressing thereof the sonde pressed against the casing towards the zone of intervention.

When the sonde has reached the selected location, the operating means are actuated so that the tubing is moved back over a distance approximately equal to half the longitudinal spacing of thrusts 6. The upper longitudinal driving thrust 6 which has been used for pushing the sonde downwards can thereby be moved away from the sonde. The operator can also make the tubing turn round on itself in case a contact between the sonde and one of the radial extensions is detected by one of sensors 9. After the planned intervention, the sonde can be moved towards another point of intervention or brought back up to the surface by displacing the tubing, and the lower thrust then rests against the sonde to drive it upwards.

When the sonde is used within the framework of production operations, acoustic or seismic sensors 10 (accelerometers, geophones, velocimeters, piezoelectric sensors, etc) allowing to monitor noises coming from the reservoir in production are generally included. It may for example be triaxial geophones allowing to detect the direction of propagation of the acoustic waves received.

Figure 2:
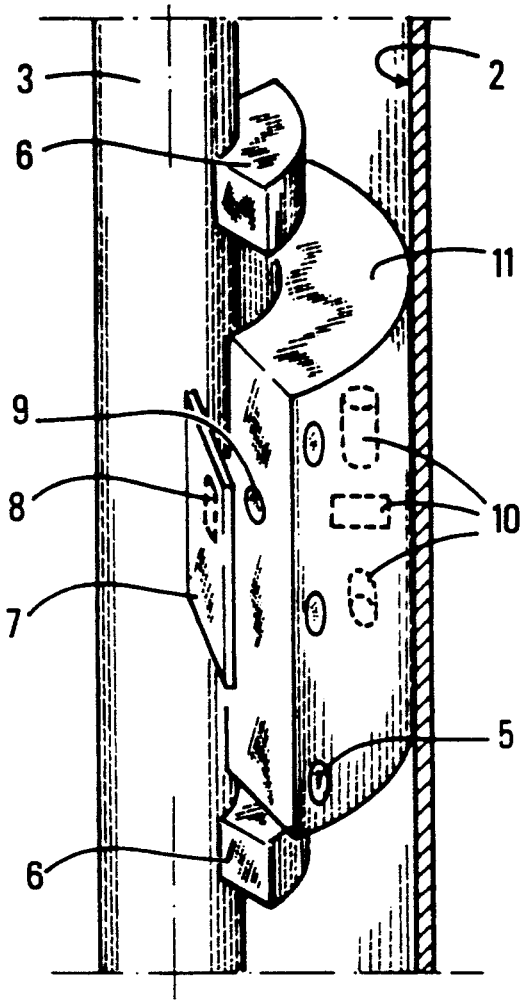
FIG. 2 shows a well sonde formed in order to obtain a proper contact with the wall of the well, also surrounded by driving means of the same type.
Figure 3:
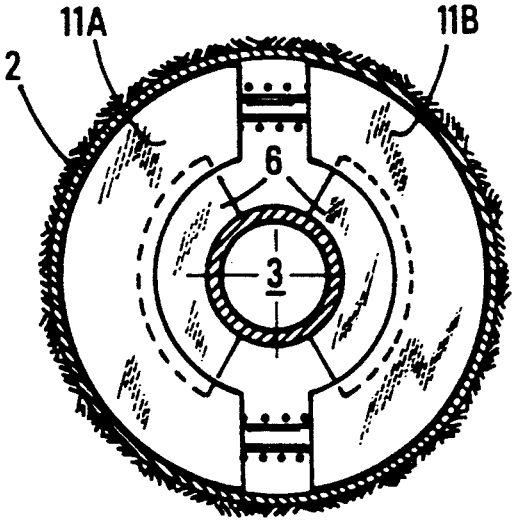
FIG. 3 shows a well sonde of annular shape consisting for example of two half shells on either side of the tubing, loosely linked to one another.
Figure 4:
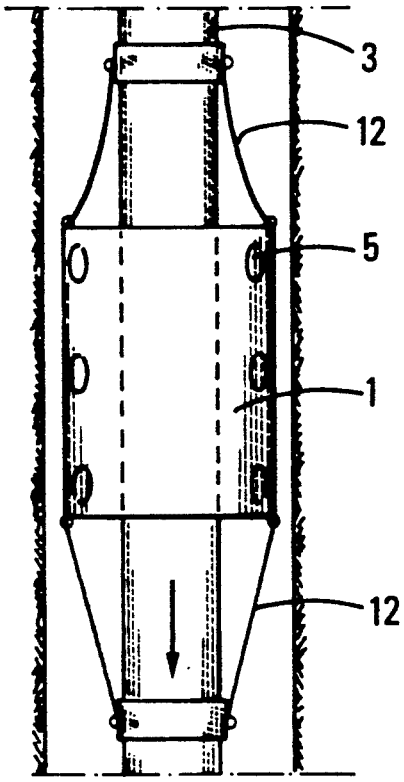
FIG. 4 shows a second embodiment procedure wherein the driving means comprise linking cables.

The sonde being pressed against the casing, a proper acoustic coupling of the sensors with the formation is obtained in the contact zone. A sonde 11 having an outer wall with a bending radius substantially identical to the bending radius of the casing (FIG. 2) is preferably chosen in order to enlarge this zone. This rounded-walled sonde can have the shape of a more or less large angular sector, depending on the cases. When sensors are to be arranged over the total periphery of the well, a ring-shaped sonde (FIG. 3) divided into several parts is used. The sonde is for example made up of two half-shells 11A and 11B joined together so that each one keeps a mobility sufficient for remaining pressed against the casing in any circumstance, and provided each with magnets holding them against the casing. The ring constituting the sonde can of course also be subdivided into several angular sectors identically distributed around the tubing. Spacings sufficient for allowing fluids to flow possibly through are provided between the different parts.

Figure 5:
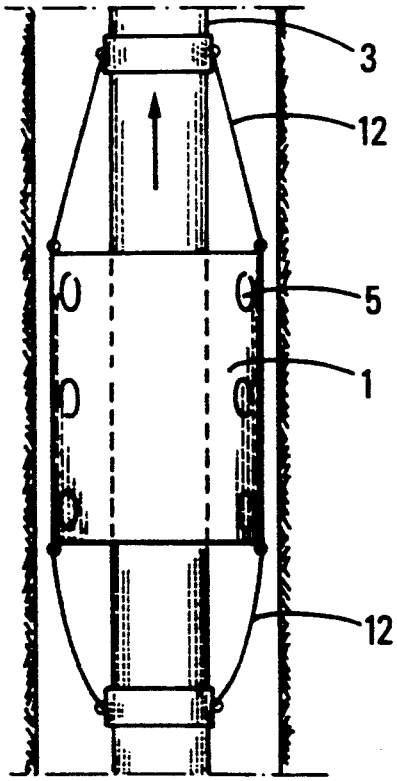
FIG. 5 diagrammatically shows the layout of the same cables during a motion of the stiff linking element in the opposite direction.

According to a second embodiment procedure, the means for driving the sonde consist of flexible cables or slings 12 made of steel or of nylon. The cables are fastened to the sonde on one hand and to points of tubing 3 on the other hand. The longitudinal spacing of these cable fastening points is higher than the length of the sonde. The length of the cables is selected in such a way that all are slack in an intermediate position of the sonde and that they cannot transmit any interfering vibrations to the sonde. Displacing the sonde towards the area of intervention is obtained by exerting a traction on the sonde by means of the lower cables. Taking up the sonde is obtained (FIG. 5) by exerting a traction by means of the upper cables 12.

Whatever the embodiment procedure may be, the sonde can be made up of two parts. A first part 13 containing sensors and provided with magnets is pressed against the casing. A second part is contained in a box 14 which is for example fastened to the stiff tubing and it is linked to the first part by flexible electric conductors 15. This second part is adapted for acquiring the signals received by the sensors of sonde 13 and for transmitting them on linking cable CL connected at the surface with the control and recording array.

According to a a variant of the previous embodiment procedure, the connection provided between the sonde and the acquisition box 14 by flexible electric conductors can be replaced with electromagnetic transmission means when the rate of the signals to be transmitted is not too high.

Figure 7:
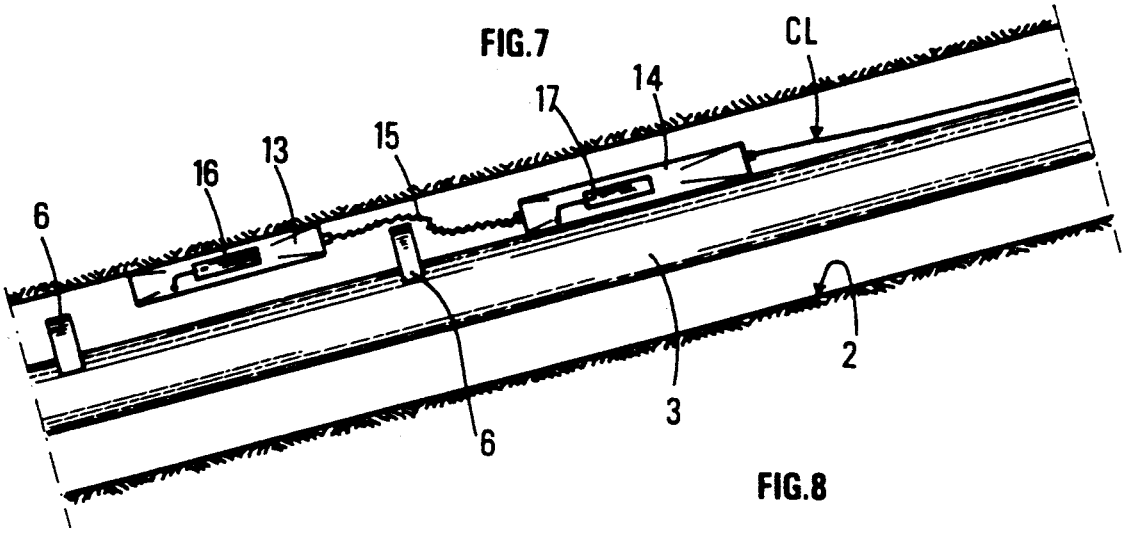
FIG. 7 shows the embodiment procedure of a means such as a pendulum for example in the case of a deflected well, for checking the orientation of each sonde in a deflected well.

Means for obtaining a precise angular positioning of the sonde containing the sensors can be used. In case the sonde is placed in a deflected part of a well (FIG. 7), the angular measuring elements that are utilized are for example of the pendulum type, with an electric potentiometer for measuring the position of the vertical plane in which it is placed.

According to an embodiment procedure, two angular measuring elements 16, 17 of this type are used. One of them, 16, is associated with the sonde pressed against the casing and the other one, 17, is associated with an electronic box fastened to the tubing. By making the tubing turn round on itself, the sonde is placed in a determined plane and, by evening out the information provided by the two elements 16, 17, they are placed substantially in the same radial plane.

The described embodiment procedures allow to obtain a very good coupling between acoustic or seismic sensors and the wall of the well. In order to increase the efficiency thereof in detecting the noises coming from the surrounding formations, the sensors can be protected against the guided waves propagating along the well by insulating them with one or several acoustic screens 18 fastened to the tubing, which seal the annulus between the tubing and the casing.

Figure 10:
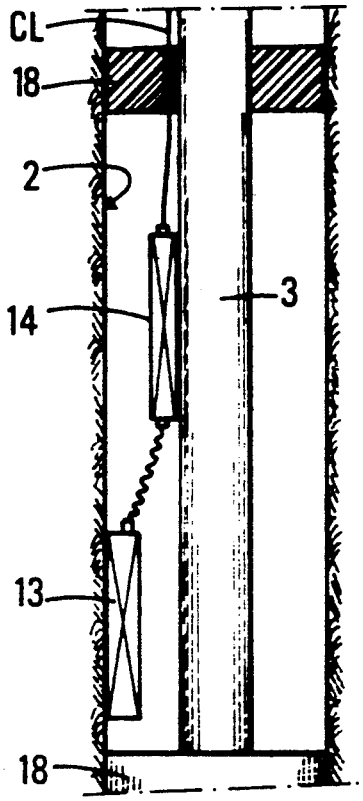
FIG. 10 shows a method of utilization of the device with the setting up of an acoustic screen.
Figure 6:
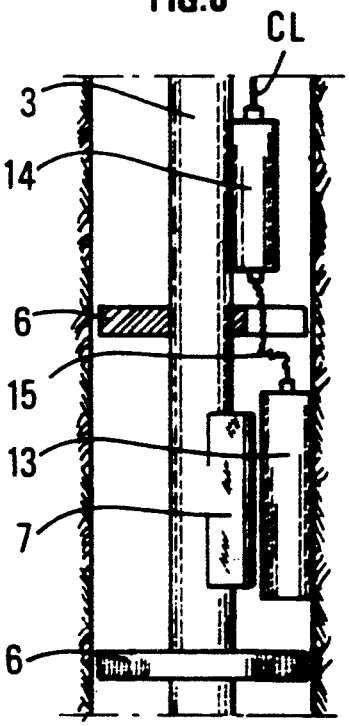
FIG. 6 shows an embodiment procedure wherein the sonde containing the sensors is connected with an acquisition and transmission box fastened to the stiff linking element.

According to the embodiment procedure of FIG. 10, the sonde is arranged above and close to a packer 19 confining for example a producing zone, and it is topped by an acoustic screen 18 capable of damping considerably the guided waves.

The section of the sonde may sometimes be too large for the annular space which is provided. In this case, off-centering devices can be used for offsetting the tubing laterally, at least in the zone of installation of the sonde.

Figure 8:
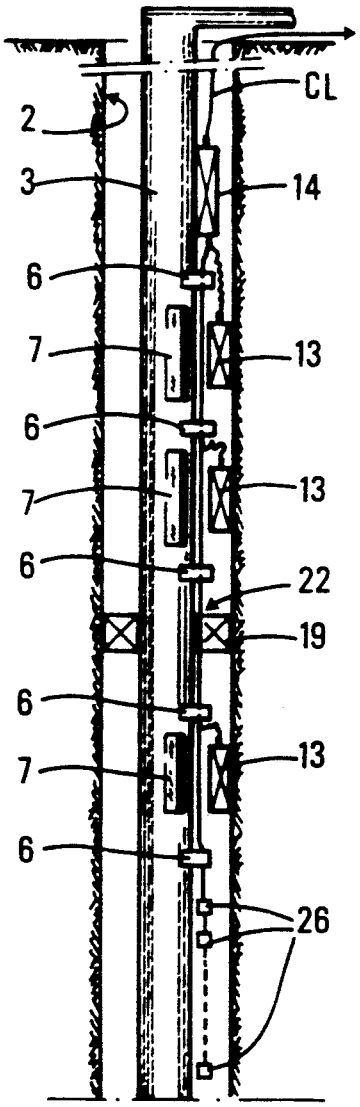
FIG. 8 shows a procedure for implementing the method wherein the means used are distributed on either side of an element sealing the well.
Figure 9:
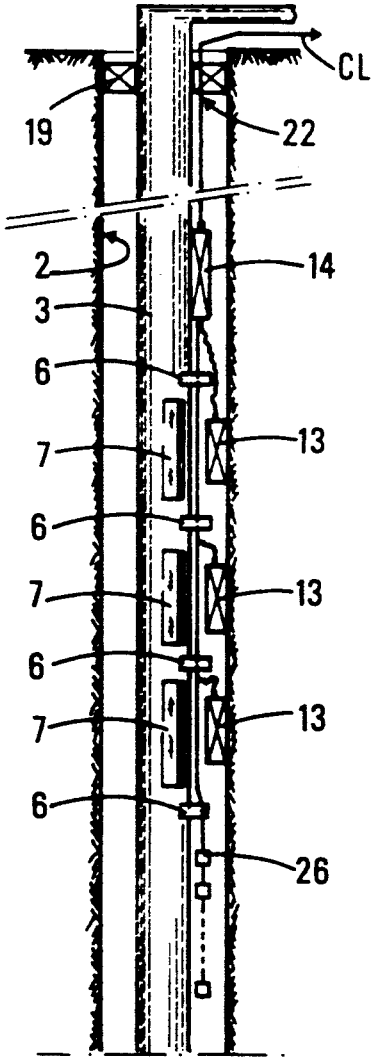
FIG. 9 shows a variant of the previous implementing procedure wherein the means used are all arranged above an element sealing the well.

The implementing procedure schematized in FIGS. 8, 9 allows to obtain a more comprehensive set of data. It is suitable for certain applications notably in oil producing wells in which a tubing 3 fitted towards the base thereof with an expansible sealing element 19 of the packer type for example for confining the subsurface zone where interventions are performed, either for the bringing in thereof, or for fracturing operations with the injection of fracturing agents for example, is taken down. In this case, the electronic box is connected on one hand with the sonde 1 magnetically coupled to the wall of casing 2 and on the other hand with auxiliary sensors adapted for measuring certain parameters in the confined zone.

The auxiliary sensors can comprise hydrophones for measuring the pressure prevailing in the confined zone. They are connected with the electronic box by conductors 22 crossing sealing element 19. These sensors can be coupled or not with the casing.

More or less complex measuring devices can be installed with the method according to the invention. According to the implementing procedure in FIG. 8, the packer 19 is arranged towards the producing zone. Above the packer, one or, in some cases, several boxes 13 containing sensors are pressed against the wall of the casing, each one associated with the pushing thrusts 6 and the centering extensions 7 thereof. The sensor boxes 13 are for example connected with a common data acquisition and transmission or electronic box 14. On the opposite side of the packer, a string of auxiliary sensors can be arranged in order to carry out measurings at several different depths which, in the case of hydrophones, allows buried focus effects. One or several sensor boxes 13 can be possibly added to them. The auxiliary sensors and these possible boxes are all connected through packer 19, by conductors 22, with the electronic box 14.

According to the implementing procedure of FIG. 9, sealing element 19 can also be arranged towards the well head. In this case, the assembly consisting of the measuring device with the sensor boxes 13 and the electronic box 14 thereof and all the auxiliary sensors is arranged under the sealing element.

I claim:

1. A method for effecting a measurement in a well provided with a metallic casing, through the temporary setting up, at selected measurement locations along the well, of measuring equipment comprising at least one measuring sonde linked by transmission means to a control and recording array, comprising:

adding to each sonde a magnetic coupling means capable of holing the sonde against an inner wall of the casing, moving each sonde held against said inner wall by a magnetic coupling means along the well with a stiff driving means connected to an operating device and coupled with each sonde and, before any measurement by each sonde, uncoupling each sonde from said stiff driving means by effecting a longitudinal displacement of the stiff driving means with relation to the sonde.

2. A method as claimed in claim 1, wherein movement of each sonde is effected by placing a driving element of the stiff driving means in direct contact with the sonde and moving the stiff driving means to displace each sonde.

3. A method as claimed in claim 2 wherein said stiff driving means comprises a stiff tubing and a plurality of driving elements fastened thereto, each sonde being moved by contacting a driving element forming a thrust member against said sonde, two of said driving elements being fastened to the stiff tubing on either side of the sonde and located at a longitudinal distance in relation to one another that is greater than the largest longitudinal dimension of the sonde, and said sonde being laterally moved by contact with driving elements forming radial centering parts for limiting the angular clearance of said sonde in relation to the stiff tubing.

4. A method as claimed in claim 1, wherein movement of each sonde is effected by exerting a tractive force on flexible cables connecting said sonde to the stiff driving means.

5. A method as claimed in any one of the previous claims comprising transmitting signals received by the sensors in a sonde to the control and recording array by means of an intermediate box fastened to said stiff driving means.

6. A method as claimed in claim 5 wherein said signal transmission is performed by flexible linking conductors.

7. A method as claimed in claim 5 wherein said signal transmission is performed through an electromagnetic transmission means between said sonde and the intermediate box and through conductors between the intermediate box and the control and recording array.

8. A method as claimed in claim 7 comprising also using means for measuring the angular orientation of the stiff driving element allowing by comparison the uncoupling of said sonde in relation to said driving means.

9. A method as claimed in claim 8 wherein said stiff driving means comprises a stiff tubing externally provided with driving elements for displacing said sonde pressed against said casing; said sonde begin moved by one of said driving elements.

10. A device for carrying out a measurement in a well equipped with a metal casing, comprising measuring equipment comprising at least one sonde which contains measuring instruments of sensor and which has magnets capable of holding the sonde pressed against an inner wall of the casing in said well and a stiff driving means having driving elements for moving said sonde pressed against the inner wall of said casing.

11. A device as claimed in claim 10 wherein said stiff driving means comprises a stiff tubing and said driving elements fastened to said stiff tubing, said driving elements comprise thrust members which can be brought to rest against the sonde pressed against the inner wall through the displacement of said tubing.

12. A device as claimed in claim 10 wherein the driving elements comprise slings or flexible cables which are fastened to a stiff tubing and to said sonde, and which can be tightened through displacement of said stiff tubing.

13. A device as claimed in any one of claim 10 and 11 further comprising means for determining the physical contact between said sonde and said driving elements.

14. A device as claimed in any one of claims 10 to 12 comprising a data acquisition and transmission array linked to each sonde by flexible electrical conductor means.

15. A device as claimed in any one of claims 10 to 12 comprising angular measuring means for determining the position of said sonde in the well.

16. A device as claimed in claim 10 wherein the stiff driving means comprises a tubing provided towards the base thereof with an expansible sealing element, said measuring equipment also comprising auxiliary sensors operatively associated with each other by electrical conductors crossing said sealing element.

17. A device as claimed in claim 16 comprising a plurality of sondes associated with said tubing in different locations along the tubing at least on one side of said sealing element and a plurality of auxiliary sensors arranged on a single side of said sealing element.

18. A device as claimed in claim 10 wherein said stiff driving means comprises a plurality of stiff tubular sections connected to each other, at least some of the tubular sections having said driving elements fastened thereto.

* * * * *